United States Patent [19]

Hoshika et al.

[11] Patent Number: 4,699,499

[45] Date of Patent: Oct. 13, 1987

[54] IMAGE FORMING APPARATUS

[75] Inventors: Norihisa Hoshika, Kawasaki; Hiroyuki Adachi, Hachiohji; Kimio Nakahata, Kawasaki, all of Japan

[73] Assignee: Canon Kabushiki Kaisha, Tokyo, Japan

[21] Appl. No.: 948,428

[22] Filed: Dec. 13, 1986

Related U.S. Application Data

[63] Continuation of Ser. No. 814,968, Dec. 31, 1985, abandoned.

[30] Foreign Application Priority Data

Jan. 10, 1985 [JP] Japan ..... 60-002540

[51] Int. Cl.[4] ..... G03G 15/16

[52] U.S. Cl. ..... 355/3 CH; 355/3 TR; 271/307; 271/900

[58] Field of Search ..... 355/3 CH, 3 TR, 3 R; 271/900, 307; 361/214, 220, 212

[56] References Cited

U.S. PATENT DOCUMENTS

| | | | |
|---|---|---|---|
| 4,183,653 | 1/1980 | Satomi et al. | 355/3 CH |
| 4,190,348 | 2/1980 | Friday | 355/3 CH |
| 4,263,636 | 4/1981 | Testone | 361/220 X |
| 4,341,457 | 7/1982 | Nakahata et al. | 355/3 CH |
| 4,400,081 | 8/1983 | Yamashita et al. | 355/3 CH |
| 4,449,808 | 5/1984 | Abrell | 355/3 CH |
| 4,540,275 | 9/1985 | Iwahashi | 355/3 CH |
| 4,579,441 | 4/1986 | Hart et al. | 355/3 CH |

*Primary Examiner*—R. L. Moses

*Attorney, Agent, or Firm*—Fitzpatrick, Cella, Harper & Scinto

[57] ABSTRACT

An image forming apparatus includes an image bearing member on which a toner image is formed. The toner image is transferred onto a transfer material by contacting the transfer material to the image bearing member and applying corona discharge to the back side of the transfer material. The present invention is characterized by the charge removing needles to which a particular voltage is applied. The voltage is such that the discharge occurs between the charge removing electrode needles and the back side of the transfer material when it is present, or the surface of the image bearing member when it is absent only when the transfer corona discharger is operated, and therefore, the air surrounding the needles is ionized. Thus, the discharge does not occur when the transfer charger is not operated, but occurs automatically when the transfer charger is operated.

9 Claims, 4 Drawing Figures

IMAGE FORMING APPARATUS

FIELD OF THE INVENTION AND RELATED ART

The present invention relates to an image forming apparatus such as an electrophotographic copying apparatus and an electrostatic recording apparatus. More particularly, the invention relates to a transfer material separating technique wherein, after an image formed on a photosensitive member of an electrophotographic copying apparatus, for example, is developed into a toner image, which is then transferred onto a transfer material brought into contact with the surface of the photosensitive member, the transfer material is separated from the photosensitive member.

The electrophotographic copying apparatus widely used comprises a photosensitive member, charging means, image exposing means, developing means, image transfer means and separating means and so on, disposed around the photosensitive member. The photosensitive member is uniformly charged by the charging means and then exposed to image light so that an electrostatic latent image is formed thereon. The electrostatic latent image is then developed with electrically charged toner particles. The developed image is transfered onto a transfer material, e.g., a sheet of paper, by closely contacting the transfer material to the photosensitive member, while corona discharge having a polarity opposite to the polarity of the toner particles is applied to the back surface of the transfer material. After the image transfer, the transfer material is separated from the photosensitive member and is transported to an image fixing device.

In the electrostatic image transfer step using the corona discharger disposed at the back side of the transfer material in the electrostatic copying apparatus described above, an electrostatic attraction force is produced between the transfer material and the photosensitive member with the result that they are closely contacted. Therefore, it is necessary to provide separating means for separating the transfer material from the photosensitive member against the electrostatic attraction force.

As for the separating means for this purpose, there are mechanical means such as a separation pawl and a separation belt. However, those means are disadvantageous in that they may scrape off a part of an image, or damage the photosensitive member. As for another means, air is blown or the transfer material is sucked from the photosensitive member. Those methods, however, each require a complicated and bulky mechanism, and in addition the toner particles may scatter around within the copying apparatus.

There is another separating method wherein a separation charger is disposed along the passage of movement of the photosensitive member and the transfer material. The separating charger is effective to discharge the back side of the transfer material by its charge removing function. By this, the transfer material is separated electrostatically from the photosensitive member. In this method, the electrostatic attraction between the surface of the photosensitive member and the transfer material is removed by the separating charger so as to eliminate the attaching force. Then, the transfer material naturally separates from the photosensitive member due to its own weight and rigidity. This method is relatively satisfactory in the separating operation as compared with the above described mechanical separation. However, this method utilizing the separating charger, requires a high voltage power source in addition to that for the image transfer and is disadvantageous in that it is expensive and bulky.

As for a separating device which does not involve the disadvantages of the device using the separating charger, Japanese Laid-Open patent application No. 152889/1979 and Japanese Laid-Open patent application Publication No. 133579/1984 have made some proposals. The former publication, No. 152889/1979 proposes that the corona discharging electrode for the image transfer and the corona discharging electrode for the separation of the transfer material be disposed within the same shield and those electrodes be connected to the same AC power source. By doing so, it is not necessary to use a particular power source for the separation in addition to the power for the image transfer. The publication states that the size of the separating device is made smaller and the manufacturing cost is reduced. However, the publication does not disclose or teach how high voltage is applied to the separation electrode, so that it is still not certain whether a satisfactory separating effect can be achieved.

The latter publication, that is, No. 133579/1984 proposes that a separation electrode in the form of discharging brush electrodes, be relative to the photosensitive member with a clearance of 0.76-1.27 mm, and that a voltage of −600 to −1000 volts be applied to the discharging electrode. According to this method, a costly high voltage power source is not required specifically for the separation corona discharger, and what is required is a relatively inexpensive and small-sized DC source, so that the size and the cost of the device can be decreased. However, as described above this publication requires a small clearance between the discharging electrode brush and the photosensitive member. It would be practically impossible to fix the discharging electrode brush so as to completely prevent the transfer material from contacting the electrode brush, in consideration of the case where thin, less rigid and easily deformed paer is used. If the transfer material is contacted to the discharging electrode brush when the humidity is high, and therefore, the electric resistance of the transfer material is decreased, the image transfer does not occur at the point where the electrode is contacted.

Additionally, when there is no paper in the transfer station as a result of, for example, paper jam, the toner particles charged to the opposite polarity and deposited on the background image area are transferred to the discharging electrode brush to which the voltage of the polarity opposite to that of the oppositely charged toner is applied, when the photosensitive member passes by the discharging electrode brush. This is because the discharging brush electrode is very close to the photosensitive member, and because a bias voltage is applied thereto. The toner particles deposited to the electrode brush can contaminate the back surface of the transfer material when the next transfer sheet reaches that point.

SUMMARY OF THE INVENTION

Accordingly, it is a principal object of the present invention to provide an image forming apparatus with a transfer material separating device which does not involve the conventional problems.

It is another object of the present invention to provide an image forming apparatus with a transfer material separating device which does not scrape off the toner which has been transferred onto the transfer material, which does not scratch the photosensitive member, which is small in size and which is low in cost.

It is a further object of the present invention to provide an image forming apparatus with a transfer material separating device which does not produce void image transfer under high humidity conditions.

It is a further object of the present invention to provide an image forming apparatus with a transfer material separating device which does not contaminate a back side of the transfer material.

It is a further object of the present invention to provide an image forming apparatus with a highly economical transfer material separating device.

It is a further object of the present invention to provide an image forming apparatus with a transfer material separating device wherein a discharging operation automatically starts in response to application of the voltage to a transfer charger.

It is a further object of the present invention to provide an image forming apparatus with a transfer material separating device wherein the separation and transportation of the transfer material is smoothly and positively effected.

According to an embodiment of the present invention, the image forming apparatus comprises transfer discharge means for applying a bias voltage to a transfer material to transfer a toner image from an image bearing member to the transfer material, discharging needles for removing the electric charge deposited on the transfer material by the discharging means, the needles being disposed downstream of the discharging means in the direction of transfer material transportation, and power source means for always applying to the needles a voltage by which the electric discharge occurs between the needles and the transfer material due to the surrounding air being ionized by operation of the discharging means.

The discharge between the needles and the transfer material occurs when the transfer discharger is operated, because the operation thereof ionizes the surrounding air thus decreasing its impedance.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
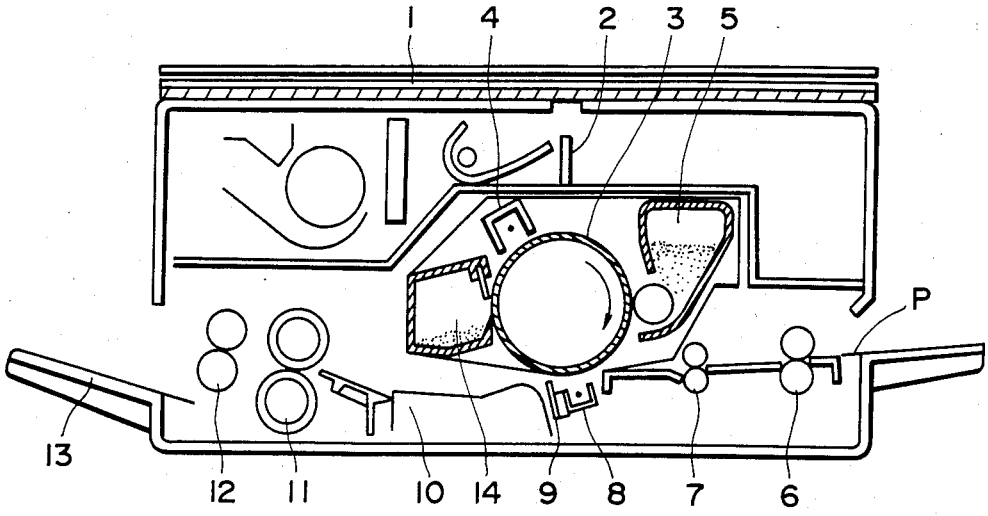
FIG. 1 is a sectional view of an electrophotographic copying apparatus provided with a transfer material separating device according to an embodiment of the present invention.

Referring to FIG. 1, there is shown an electrophotographic copying apparatus of a small size provided with a transfer material separating device for separating a transfer material (paper). The copying apparatus comprises an original carriage made of a transparent member such as glass. The original carriage is reciprocable horizontally. The apparatus further comprises an array or arrays of short focus small-diameter imaging elements for forming an image of an original to be copied, placed on the original carriage, onto a photosensitive member 3 through a slit. The photosensitive member 3 is shown as a photosensitive drum, but may be a web movable along an endless passage. A charger 4 serves to uniformly charge the photosensitive member 3.

In operation, the photosensitive member 3 is uniformly charged by the charger 4 and then is exposed to image light of the original through the array of the imaging elements so that an electrostatic latent image is formed. Subsequently, the electrostatic latent image is developed by a developing device 5. On the other hand, the transfer paper P is fed to the photosensitive member 3 in timed relation with the photosensitive member 3 by the pick-up roller 6 and the registration roller 7 such that the transfer paper P is aligned with the image on the photosensitive member. The toner image on the photosensitive member 3 is transferred onto the transfer paper by the transfer charger producing corona discharge for image transfer.

The transfer paper P is separated from the photosensitive member 3 by a discharger 9, according to the present invention, which comprises an insulating member 19 and discharging needles **9*a* of conductive material, which will be described in detail hereinafter. The transfer paper is transported to the fixing device 11 by the transportation belt 15 along a guide 10. By the fixing device 11, the toner image is fixed on the transfer paper P. The transfer paper is discharged by discharging rollers 12 onto a tray 13. The photosensitive member 3, the charger 4, the developing device 5 and the cleaning device 14** may be constructed as a unit which is mountable into or demountable from a main assembly of a copying apparatus in the manner disclosed in U.S. Pat. No. 4,470,689, so that the unit may be replaced as a whole so as to make the maintenance operation easier.

Figure 2:
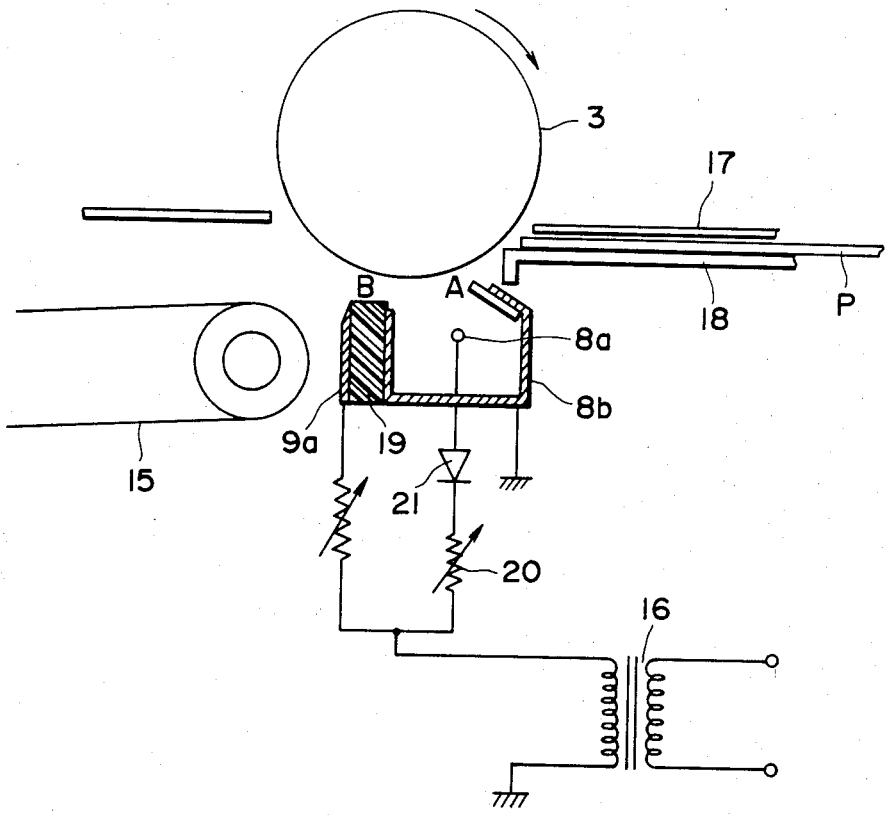
FIG. 2 is an enlarged sectional view of the separating device of the apparatus of FIG. 1
Figure 3:
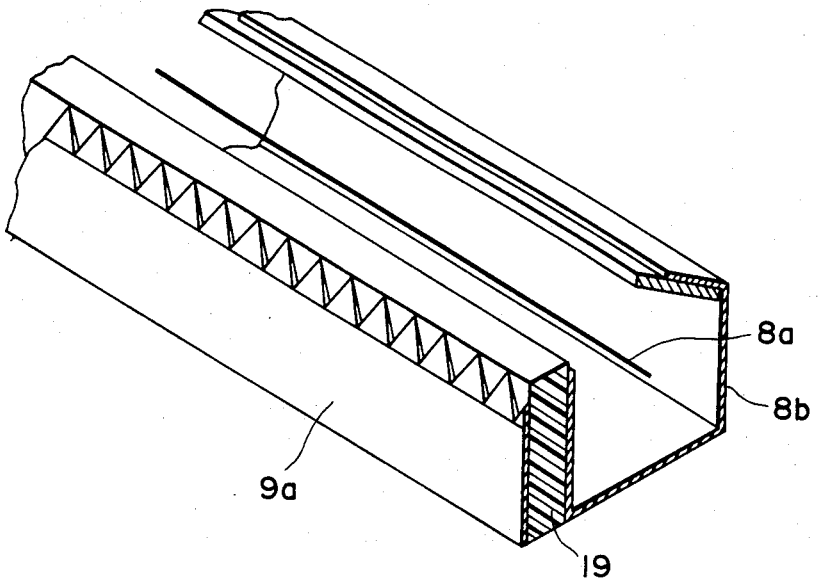
FIG. 3 is a perspective view of needle electrodes and a transfer discharger according to the present invention, wherein the tip ends of the discharging electrodes are exaggerated.

FIG. 2 is an enlarged sectional view of the transfer material separating means of the electrophotographic copying apparatus of FIG. 1. FIG. 3 is a perspective view illustrating the charge removing needles of FIG. 2 devices. Referring to these Figures, the present invention will be described in further detail. It is assumed, for explanation, that an electrostatic latent image of negative polarity is formed on the photosensitive member 3, and the latent image is developed with toner particles positively charged.

The transfer charger 8 includes a corona wire **8*a* spaced by a predetermined clearance from the photosensitive member 3 and stretched parallel to its rotational axis to cover the entire width thereof and a shield 8*b* enclosing the corona wire. To the corona wire 8*a*, electric power is applied from a high voltage source unit 16 after the AC output thereof is rectified and smoothed by a resistor 20 and diode 21. The shield 8*b* is grounded to control the corona discharge from the corona wire 8*a* to the photosensitive member 3 surface. The voltage supply to the transfer corona wire 8*a*** is rendered on and off by a proper sequence matching the image transfer operation.

The transfer material separating device includes a discharger 9 for discharging the back side of the transfer material. The discharger 9 includes an insulating member 19 fixed to such a lateral side of the shield **8*b* of the transfer charger 8 as to be the downstream side with respect to transportation of the transfer paper P and charge removing needles 9a mounted to the insulating member 19 in such a manner that the tip ends of the charge removing needles 9a do not project beyond the top surface of the insulating member 19. Because the tip ends of the charge removing needles 9a are retracted from the top surface of the insulating member 19, the leading edge of the transfer paper P is received by the insulating member 19, whereby the transfer paper P is conveyed along the guide 10 (FIG. 1) toward the transporting belt 19 (FIG. 2**).

In operation, the transfer paper P is advanced to the photosensitive member 3 bearing a toner image in a timed related therewith so as to be aligned with the image thereon through the clearance between the top transfer paper guide 17 and the bottom transfer paper guide 18. The transfer paper P is closely contacted to the surface of the photosensitive member 3 while passing the transfer charger 8.

When the transfer paper P passes by the transfer charger 8, a negative high voltage is applied to the corona wire 8a so as to produce negative corona toward the surface of the photosensitive member 3. Because of this, the toner image formed on the photosensitive member 3 is transferred onto the transfer paper P at a position indicated by a reference "A".

After the image transfer, that is, after the transfer paper P receives the toner image, it reaches a position indicated by a reference "B" where the separating device 9 is provided. The charge removing needles 9a are supplied with AC high voltage through the high voltage source unit 16. It is effective to remove the electric charge from the transfer paper P after the transfer operation so that the electrostatic attracting force to the photosensitive member 3 is removed. Then, the transfer paper P separates from the surface of the photosensitive member due to its own weight and its ridigity.

In the actual device constructed in accordance with the embodiment, the transfer corona wire 8a is supplied with −4.5 to −5.5 KV, by which image transfer current −300 to −500 μA is provided. It has been confirmed that satisfactory image transfer can be obtained. It has been confirmed that it is preferable that the charge removing needles 9a be spaced apart from the surface of the photosensitive member 3 by 4–7 mm, wherein the high voltage source unit 16 is commonly used for the transfer charger 8 and the discharging needles 8a.

The discharging needles 9a are disposed within 8 mm from the downstream side outer surface of the shield 8b with respect to movement of the outer periphery of the photosensitive member 3. The discharging needles 9a are isolated from the shield 8b by an insulating member. It has been confirmed that discharging from the needles 9a is enhanced when the distance between the discharging needles 9a and the shield 8b is not more than 5 mm.

The voltage for causing the self-discharge of the discharging needles 9a, namely, the discharge between the back side charge of the transfer material and the tips of the needles 9a (in other words, the charge on the back side of the transfer material is absorbed into the needles 9a), was +4.5 KV when the tips of the needles 9a were spaced from the surface of the drum 3 by 5 mm, and when the transfer corona wire 8a was not energized. (The transfer material was separately charged to the same extent as in the transfer operation.)

When the transfer corona wire 8a was energized, the self-discharge sufficient to separate the transfer material occurred when a voltage not more than +1.5 KV and not less than 1.0 KV was applied to the discharge needles 9a where the transfer material was plain paper (not less than 50 g/m$^2$) under normal temperature and humidity (22°–23° C., 50–60%).

When, however, thin paper (40–45 g/m$^2$) was used for the transfer material, particularly when the humidity was low, the voltage less than 1.5 KV applied to the discharging needles 9a was not satisfactory. It was confirmed that the voltage was required to be higher than 1.5 KV. The voltage higher than 3.5 KV was not satisfactory since it results in void of image transfer under high humidity condition.

In the present invention, the discharging between the charge removing needle and the transfer paper does not take place solely with the voltage applied to the charge removing electrodes 9a, but occurs with the aid of decrease in the impedance of the surrounding air which is ionized by the operation of the transfer corona discharger. To achieve this, the voltage applied to the charge removing needles 9a is lower than the voltage required for the occurrence of the discharge therebetween without the decrease of the impedance by ionization. Therefore, in the present invention, the discharge between the transfer paper and the charge removing electrode is initiated in response to activation of the transfer charger resulting in decreasing the impedance of the surrounding air. This holds true irrespective of whether or not the transfer paper is present at the transfer station. Therefore, when there is no transfer paper, the discharge occurs between the charge removing electrodes and the surface of the photosensitive member which is charged by the transfer corona discharger. This is effective to discharge the surface of the photosensitive member so as to make the surface potential of the photosensitive member uniform.

In the embodiment of FIG. 2, the charge removing needles 9a are supplied with an AC voltage. It is preferable that the AC voltage is rectified and smoothed through a rectifying and smoothing circuit so as to produce a DC power of the positive polarity, since then the charge removing effect is improved.

Figure 4:
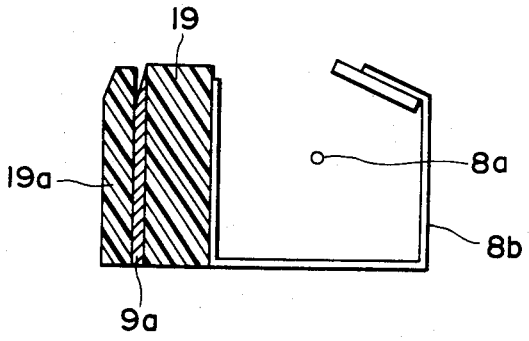
FIG. 4 is a sectional view of the transfer discharger and the needle electrodes according to another embodiment of the present invention.

FIG. 4 is a sectional view of the transfer charger and the charge removing device according to another embodiment of the present invention, wherein the charge removing needles 9a are interposed between two insulating members 19 and 19a. In this embodiment, the charge removing needles are not projected beyond the top surfaces of the sandwiching insulating members, whereby they do not obstruct the transportation of the transfer material, and whereby the unfixed toner image is not disturbed by contact of the charge removing needles to the transfer material resulting in a sudden potential variation. The charge removing needles may be in the form of a long flat or round needle having a pointed end. The distance between adjacent pointed ends of the needles is 0.5–3 mm, preferably, 1–2 mm. A plurality of sets of the charge removing needles may be arranged along the direction of the transfer material passage.

The present invention is conveniently applicable to an electrophotographic copying apparatus, an image forming apparatus wherein a latent image is formed on an insulating drum by a multi-stylus element and is developed, and an image forming apparatus wherein a charge pattern is formed on the insulating drum by one or another means and is developed. In those examples, the insulating drums may be replaced by insulating webs.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

means for forming a toner image on said image bearing member;

transfer discharge means for applying corona discharge to a transfer material which is contacted to said image bearing member to transfer the toner image from said image bearing member to the transfer material;

charge removing needles, disposed downstream of said transfer discharge means with respect to the direction of transportation of the transfer material, for removing from the transfer material the charge deposited by said transfer discharge means; and means for applying to said charge removing needles such a voltage that self-discharge occurs only when air adjacent said charge removing needles is ionized by operation of said transfer discharge means.

2. An apparatus according to claim 1, wherein the self-discharge is caused by decrease of an impedance of the air resulting from the operation of the transfer charge means.

3. An apparatus according to claim 1 or 2, wherein said charge removing needles are mounted on an insulating member.

4. An apparatus according to claim 1 or 2, wherein said charge removing needles have ends which are retracted from an end of said insulating member.

5. An apparatus according to claim 1 or 2, wherein said charge removing needles are spaced from said image bearing member by 4–7 mm and are supplied with 3.5–1.0 KV voltage.

6. An apparatus according to claim 1 or 2, wherein adjacent free ends of said charge removing needles are spaced by 0.5–3 mm.

7. An image forming apparatus, comprising:

an image bearing member;

means for forming a toner image on said image bearing member;

transfer discharge means for applying corona discharge to a transfer material which is contacted to said image bearing member to receive the toner image therefrom, to transfer the toner image from said image bearing member to the transfer material;

charge removing needles, disposed downstream of said transfer discharge means with respect to the direction of transportation of the transfer material, for removing, by self-discharge from the transfer material, the charge deposited by said transfer discharge means said needles being mounted on an insulating member, wherein said needles do not project out beyond the insulating member; and means for applying to said charge removing needles such a voltage that the discharge occurs between the charge removing needles and the transfer material or said image bearing member only when air adjacent said charge removing needles is ionized by operation of said transfer discharge means.

8. An apparatus according to claim 1, wherein the self-discharge is caused by decrease of the impedance of the air resulting from the operation of the transfer charge means.

9. An apparatus according to claim 7 or 8, wherein said charge removing needles are spaced from said image bearing member by 4–7 mm, wherein adjacent free ends of said charge removing needles is 0.5–3 mm, and wherein said charge removing needles are supplied by 1.5 or higher KV voltage.

* * * * *

UNITED STATES PATENT AND TRADEMARK OFFICE

CERTIFICATE OF CORRECTION

PATENT NO. : 4,699,499

DATED : October 13, 1987

INVENTOR(S) : NORIHISA HOSHIKA, ET AL.

It is certified that error appears in the above-identified patent and that said Letters Patent is hereby corrected as shown below:

On the Title Page:

IN THE HEADNOTE:

[22] "December 13, 1986" should read --December 31, 1986--.

COLUMN 2, line 26, after "be" insert --disposed--;

line 35, after "above" insert --,--.

COLUMN 5, line 50, "8a" should read --9a--.

IN THE CLAIMS:

CLAIM 8, line 1, "1" should read --7--.

Signed and Sealed this

Twenty-second Day of March, 1988

*Attest:*

*Attesting Officer*

DONALD J. QUIGG

*Commissioner of Patents and Trademarks*